US005967051A

United States Patent [19]

Ragsdale et al.

[11] Patent Number: 5,967,051

[45] Date of Patent: Oct. 19, 1999

[54] VEHICLE HUMAN AMUSEMENT RIDE TRACK WITH CENTERING ARRANGEMENT

[75] Inventors: Michael V. Ragsdale, Westlake Village, Calif.; Michael L. Gutknecht, Layton, Utah

[73] Assignee: Thrilltime Entertainment International, Inc., Canada

[21] Appl. No.: 09/008,461

[22] Filed: Jan. 16, 1998

[51] Int. Cl.[6] ..... A63G 1/00

[52] U.S. Cl. ..... 104/60; 104/53; 104/250; 104/252; 104/305

[58] Field of Search ..... 104/53, 60, 140, 104/145, 146, 242, 244.1, 250, 252, 259, 305

[56] References Cited

U.S. PATENT DOCUMENTS

| | | | |
|---|---|---|---|
| 4,991,514 | 2/1991 | Powell et al. | 104/60 |
| 5,361,705 | 11/1994 | Powell | 104/60 |
| 5,551,347 | 9/1996 | Gutknecht | 104/53 |
| 5,575,218 | 11/1996 | Gutknecht | 104/249 |

*Primary Examiner*—Mark T. Le
*Assistant Examiner*—Robert J. McCarry, Jr.
*Attorney, Agent, or Firm*—Jack C. Munro

[57] ABSTRACT

An amusement ride for humans which utilizes at least one vehicle which is to be operatively moved on a track. The vehicle is to be tied to the track so as to prevent separation of the vehicle from the track with this tying to the track being accomplished by a guide blade that is attached to and protrudes from the vehicle which rides within a slot arrangement formed in the track. The track includes a braking area, and within that braking area there are a plurality of braking units located in an in-line sequence. Prior to each braking area, there is a centering rail section which is included within the track. The guide blade has to pass through a centering rail section prior to the entering of each braking unit. The centering rail section includes a through centering slot. The through centering slot narrows in width with the narrowness occurring in the direction of travel. In other words, the through centering slot is tapered so that the guide blade leaves the centering section at the precise center of the centering section rather than being to one side or the other side of the centering slot. This results in the guide blade being conducted into each braking unit precisely along the longitudinal center axis of the braking unit.

10 Claims, 3 Drawing Sheets

VEHICLE HUMAN AMUSEMENT RIDE TRACK WITH CENTERING ARRANGEMENT

BACKGROUND OF THE INVENTION

1. Field of the Invention

The field of this invention relates to amusement rides for humans and more particularly to an amusement ride which is designed to be located in a permanent establishment within an amusement park.

2. Description of the Prior Art

Amusement parks are common form of entertainment for humans. Included within these amusement parks are a plurality of different types of amusement rides. Amusement rides using automobiles of various types have long been known. Reference is to be had to U.S. Pat. Nos. 5,551,347, entitled HUMAN AMUSEMENT RIDE and 5,575,218, entitled TRACK BRAKE APPARATUS WITH SLIDING SHOES AND WEAR PLATES FOR PREVENTING EXCESSIVE MOVEMENT OF THE SHOES IN THE DIRECTION OF VEHICLE MOVEMENT, both by Leroy H. Gutknecht. Both of these prior patents are directed to human amusement rides which are to be mounted in conjunction within an amusement park. Both of these prior patents are assigned to the corporate entity that is the owner of the subject matter of the present invention.

The dragster type of vehicle of the amusement rides of the aforementioned patent is restrained within a slot formed within a track. Normally, this slot is at least two to three times the width of a guide blade that protrudes from the vehicle. This means that there is a limited amount of lateral permitted of the vehicle as it moves along the track. The track includes a braking area. It has been discovered, as was described within the aforementioned patents, that it is desirable to have stages of brakes. In other words, a plurality of separate, identical braking units located in a spaced apart arrangement. It has been found to be preferable to have a braking force to be applied, and then released, reapplied and then released, reapplied and so forth to achieve the ultimate slowing of the vehicle in the shortest distance. It is most economical to use the least amount of real estate to stop the vehicle.

It has been discover that this "sloppy" lateral movement of the guide blade as it is conducted within a braking unit will result in an inferior braking force. The braking unit forcibly applies a brake pad against the guide blade on each side of the guide blade producing a squeezing action on the guide blade. If the guide blade is not centered within the braking unit, the force is unevenly applied. For a very short period of time, there is an inadequate braking force that is being applied because the guide blade is not being compressed on each side. Although this is a very short period of time, the vehicle may be moving through the braking unit at around sixty to seventy miles per hour which means the guide blade is located in conjunction with a braking unit for only a small part of a second. Also, the braking unit is of a limited length, generally about five to ten feet in length. In order to achieve the maximum braking force, it is necessary to apply the braking unit precisely upon the guide blade entering the braking unit and have that force be applied until the guide blade leaves the braking unit. If there is an inadequate force being applied within the first one foot of the braking unit, twenty percent of the overall braking force is lost if the brake unit is five feet in length.

SUMMARY OF THE INVENTION

A primary objective of the present invention is to construct a braking section of a track of a vehicular amusement ride which applies a positive and continuous braking force along the entire length of each braking unit that is associated with the braking area of the track.

Another objective of the present invention is to construct a braking area of a track of a vehicular human amusement ride where the maximum braking benefit can be obtained from the braking area during the braking operation.

The amusement ride is to utilize a vehicle such as a dragster type of vehicle. This vehicle is to be restrained within a track. Normally, the track will be imbedded within the ground with the track having an elongated through slot. Within that elongated through slot is to ride a guide blade that protrudes from the underside of the vehicle. The vehicle will generally have four tires, the two right side tires being located along the right side of the elongated slot, and the two left side vehicle tires being located along the left of the elongated slot. At the end of the acceleration area of the ride, there is incorporated a braking area which will function to automatically to slow the vehicle to a stop. The braking area includes a plurality of separate braking units. In between each braking unit is located a centering rail section. The guide blade normally has a loose fit arrangement within the elongated slot. However, before the guide rail enters a braking unit, it is desirable to have the guide blade be located precisely along the longitudinal center axis of the braking unit rather to one side or the other. The centering rail section has a through centering slot with the entrance into the through centering slot being of a width approximately equal to the width of the elongated slot formed within the elongated rail. However, the exit of the through centering slot is narrowed and is actually only slightly larger than the thickness of the guide blade. It has been found to be best that the through centering slot be tapered. When the guide blade leaves each through centering slot, it enters a brake unit precisely along the longitudinal center axis of the brake unit. Therefore, when braking pressure is applied by the brake unit on each side of the guide blade, this braking pressure is applied evenly so that the maximum braking affect can be achieved.

DETAILED DESCRIPTION OF THE PREFERRED EMBODIMENT

Figure 1:
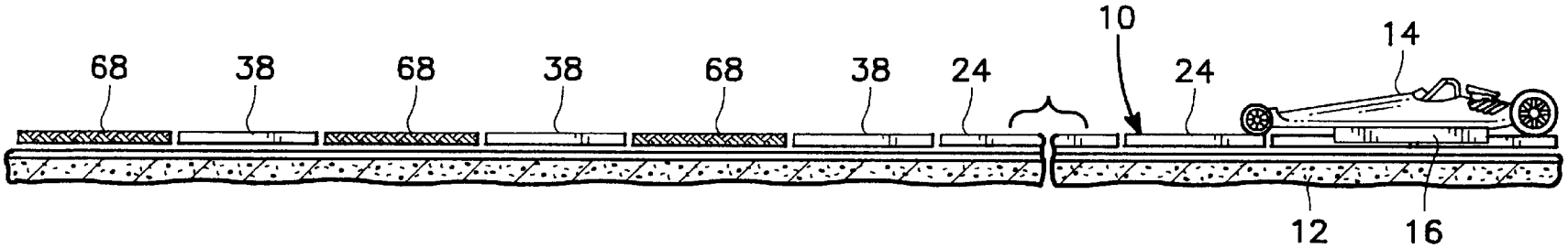
FIG. 1 is a side schematic view of a track of a human amusement ride which has been constructed to include centering rail sections showing a vehicle mounted in conjunction with the track.
Figure 2:
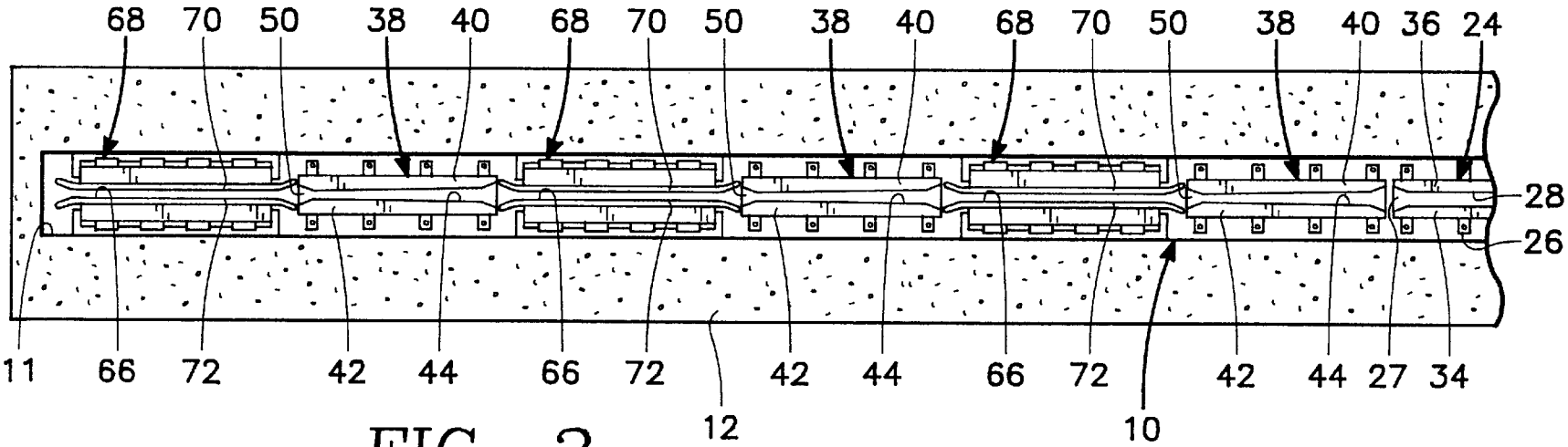
FIG. 2 is a top plan view of a portion of the braking area of the track of FIG. 1.
Figure 3:
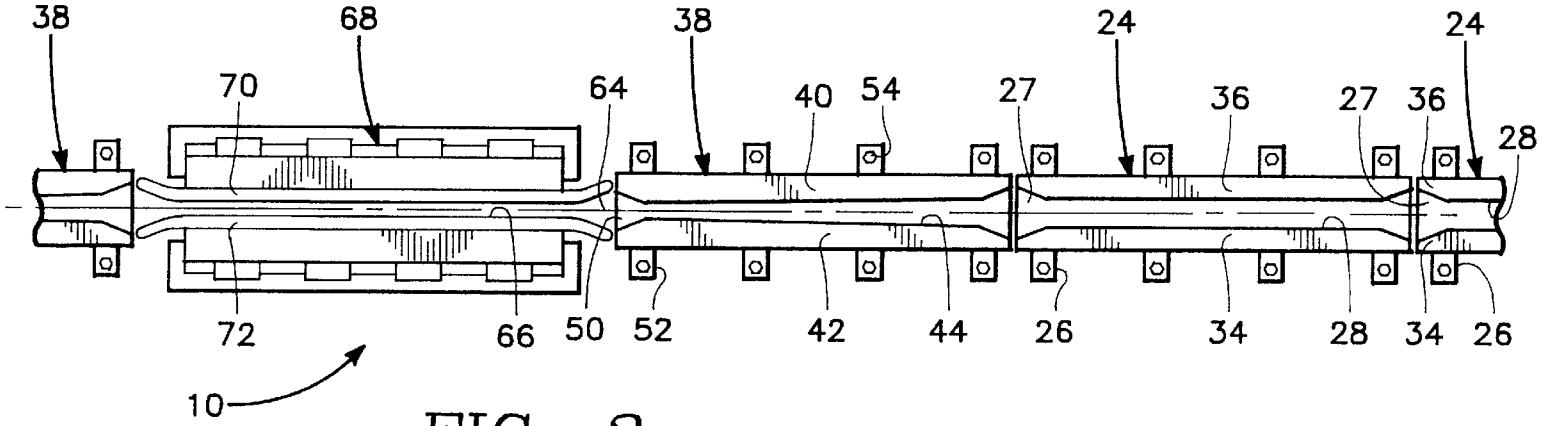
FIG. 3 is an enlarged top plan view showing the terminating of the elongated slot within the accelerating area of the track and then the utilization of a centering rail section and then a brake unit.

Referring particularly to the drawings there is shown a track 10 imbedded within cement 12 which is imbedded within ground (not shown). Normally within the cement 12 there is formed a channel 11. A typical length of the track 10 would be about three hundred seventy feet. Amusement ride vehicle 14 straddles the track 10 and is to be accelerated by the human occupant along with track 10 for about one hundred seventy five feet. This leaves about one hundred ninety five feet to slow the vehicle 14 until it actually comes to a stop. The vehicle 14 has a guide blade 16 protruding from the underside of the vehicle 14. The guide blade 16 constitutes no more than a sheet of steel which is bolted to the undercarriage of the vehicle 14. Normally, the guide blade 16 will be laterally centrally disposed relative to the undercarriage of the vehicle 14 with the longitudinal dimension of the guide plate 16 being located parallel to and in alignment with the longitudinal center axis through the vehicle 14. The thickness of the guide blade 16 would normally be about three-eighths of an inch. The guide blade 16 is fixedly mounted to the undercarriage of the vehicle 14 by bolts 18 which connect with mounting flange 20. The mounting flange 20 in turn is fixedly mounted by bolts 22 to the undercarriage of the vehicle 14.

The track 10 is actually constructed of a plurality of guide rail sections 24 which are mounted in an in-line arrangement. Each rail section 24 is of a prescribed length with generally about ten feet being preferable. Each rail section 24 is to be appropriately bolted within the cement channel 11. Each of the rail sections 24 include a plurality of side flanges 26 which are to be used to fixedly secure each rail section 24 within the cement channel 11. The side flanges 26 are integral with a base plate 27.

Each rail section 24 has a through slot 28. Within the through slot 28 is positioned the guide blade 16. The through slot 28 also includes a retaining channel, which is not shown, which is to provide for location of a retainer bar 30. The retainer bar 30 is actually composed of two sections, one on the right side of the guide blade 16 and the other on the left side of the guide blade 16, which are secured together by means of a series of bolts 32. The retainer bar 30 will prevent the guide blade 16 from disengaging from the retaining channel by movement in an upward direction since the retainer bar 30 will come into contact with the undersurface of the top plates 34 and 36 of the rail section 24. It is the function of the retainer bar 30 to insure that the vehicle 14 will always be connected to the track 10 with separation of the vehicle 14 from the track 10 being prevented in the upward direction.

The through slot 28 within each of the rail sections 24 is formed to be constant in width. A typical width would be about one inch. This means that the guide blade 16, which is three-eighths of an inch thick, will be able to move laterally five-eighths of an inch within through slot 28. This amount of lateral movement is generally desired to insure that the vehicle 14 will be operated in substantially an unrestrained manner as it moves along the track 10. However, after the last rail section 24, there is located a centering rail section 38. The centering rail section 38 is formed of top plates 40 and 42 which are located in juxtaposition but spaced apart. These top plates 40 and 42 form a through centering slot 44 therebetween. The top plate 40 is fixedly mounted onto upstanding vertically orientated plates 46 with it being understood that for each rail section 38 there will be a plurality of such plates 46. In a similar manner, the top plate 42 is mounted on a plurality of upstanding plates 48. The upstanding plates 46 and 48 are in turn fixedly mounted onto a base plate 50. The base plate 50 includes a plurality of side flanges 52. The side flanges 52 are to be used with each connecting with a bolt fastener 54 to mount the base plate 50 to the cement channel 11. The through centering slot 44 terminates at each end in a flared end which is actually not part of the through centering slot 44.

Mounted on each of the upstanding plates 46 is a U-shaped plate 56. A similar U-shaped plate 58 is fixedly mounted on the upstanding plates 48. The U-shaped plates 56 and 58 are located in a facing relationship relative to each other. Formed between the U-shaped plates 56 and 58 is a gap 60 with this gap 60 to be considered part of the through centering slot 44 of the centering rail section 38. The lower end of the guide blade 16 is to be located within the gap 60.

Figure 4:
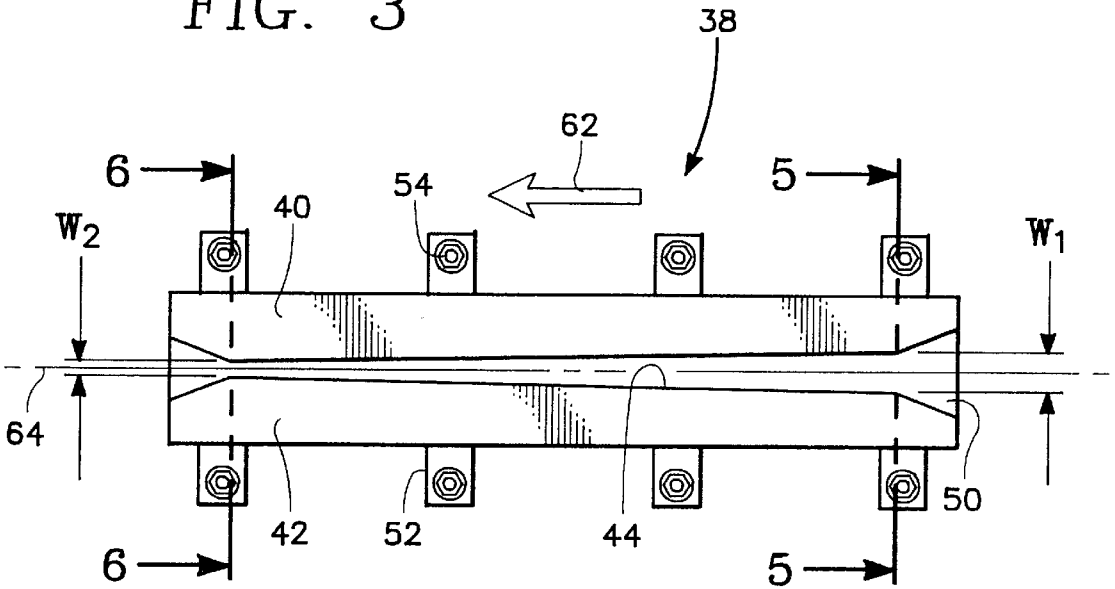
FIG. 4 is an enlarged top plan view of a centering rail section utilized in conjunction with this invention.
Figure 5:
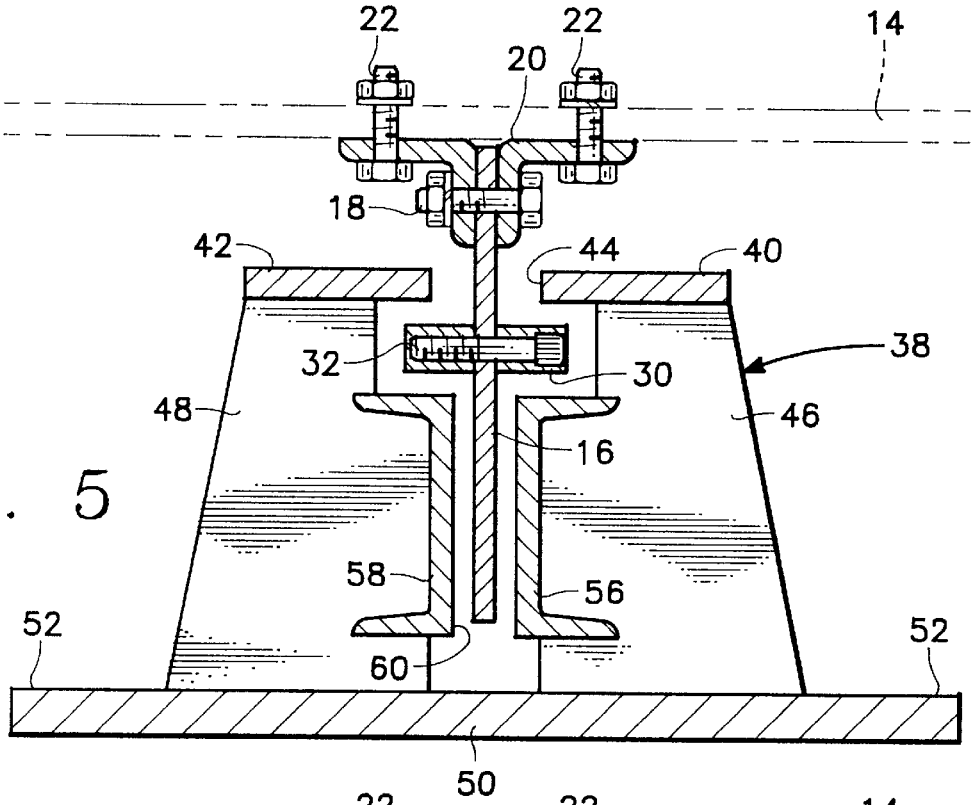
FIG. 5 is a transverse cross-sectional view at the entrance end of the centering rail section taken along line 5—5 of FIG. 4.

Paying particular reference to FIG. 5 of the drawings, it can be seen there is shown the entrance area of the through centering slot 44. The width of the centering slot 44, in the entrance area between the top plates 40 and 42, is defined as $W_1$ in FIG. 4 and is approximately equal to the same spacing between the top plates 34 and 36 of the rail sections 24. This results is the width of the gap 60 to be about one inch in the entrance area of the centering rail section 38. The direction of travel of the guide blade 16, which is also the direction of travel of the vehicle 14, is indicated by arrow 62 within FIG. 4.

Figure 6:
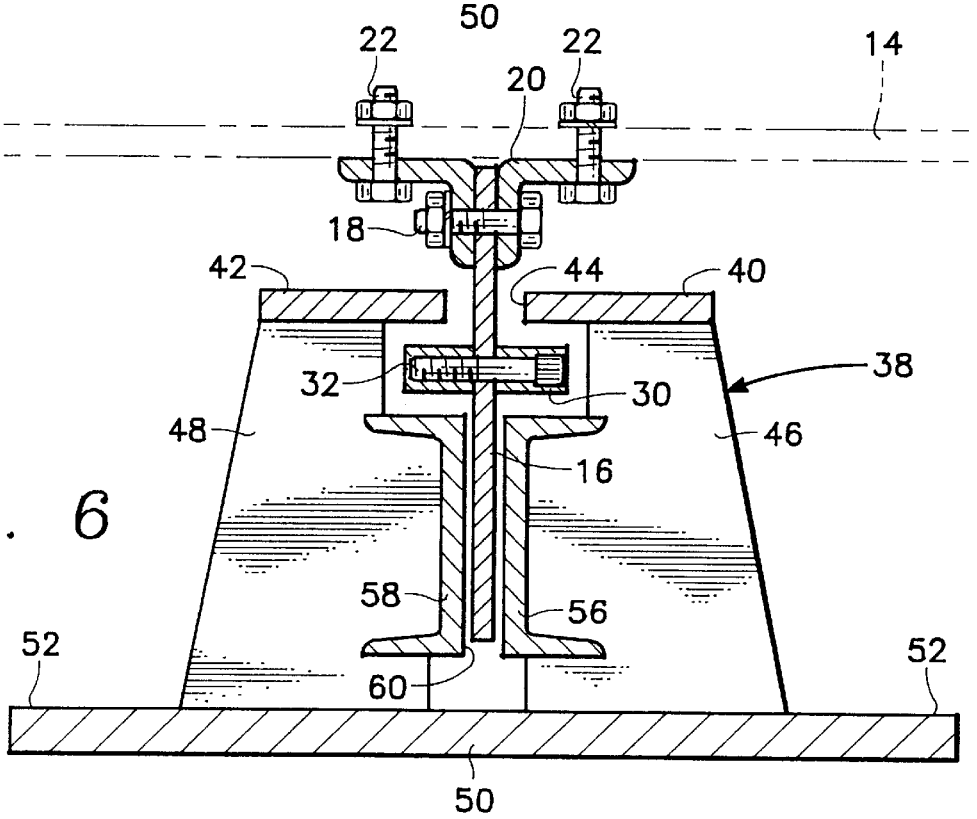
FIG. 6 is a transverse cross-sectional view at the exit end of the centering rail section taken along line 6—6 of FIG. 4.

It is to be noted that the width of the through centering slot 44, within the exit area, is defined as $W_2$ within FIG. 4. $W_2$ has been narrowed substantially to be about one-half inch wide in the exit area which is shown in FIG. 6. This leaves about one-sixteenth inch of spacing in the gap 60 on each side of the guide blade 16 between the wall surface of each of the U-shaped plates 56 and 58. The result is the guide blade 16 is now aligned rather precisely with the longitudinal center axis 64 of the track 10. It is normally preferred that this decreasing of the exit area of the gap 60 versus the entrance area of the gap 60 is to be accomplished by tapering of the through centering slot 44 although a stepped down configuration incorporated into the wall surfaces of gap 60 could be used. Therefore, as the guide blade 16 maneuvers through the through centering slot 44, the position of the vehicle 14 is maneuvered so as to be located precisely with the guide blade 16 on the longitudinal center axis 64. This maneuvering occurs by the guide blade 16 bouncing off the surface of the U-shaped plates 56 and 58 and being forcibly moved until the guide blade 16 is aligned with the longitudinal center axis 64.

Upon the guide blade 16 leaving through centering slot 44 and being located precisely on the longitudinal center axis 64, it enters the through braking slot 66 located within the brake unit 68. The through braking slot 66 is formed by the gap area between brake pads 70 and 72. Again, the braking slot 66 has ends which are flared but these flared ends are not considered to be part of the braking slot. The brake pads 70 and 72 are to be movable toward and away from each other by being squeezed toward each other with brake pad 70 pressing against one side of the guide blade 16 and brake pad 72 pressing against the opposite side of the guide blade 16. Therefore, the width of the through braking slot 66 varies from a wide or maximum width which would permit free passage of the guide blade 16 through the braking slot 66 to a minimum width which is equal to the thickness (three-eighths of an inch) of the guide blade 16. This creates the braking force that causes the vehicle 14 to slow. Typically, brake units 50 and 68 will be of a given length, such as about five or ten feet. For a detailed description of the structure of each of the brake units 68, reference is to be had to prior U.S. Pat. No. 5,575,218.

Because the guide blade 16 is directed precisely along the longitudinal center axis 64 into the through braking slot 66, the pressure applied by the brake pads 70 and 72 will be applied evenly and at the same rate on each side of the guide blades 16 thereby applying a smooth, continuous braking force which maximizes the amount of braking force that is produced within each brake unit 68. This will minimize the number of brake units 68 that are to be used with generally about ten in number being used. Each of the brake units 68 will be separated by a centering rail section 38 which will generally be between five and ten feet in length.

What is claimed is:

1. A track vehicle amusement ride, said vehicle having a guide blade, said track comprising:

a guide rail section having an elongated slot located between first flared ends of said guide rail section, said first flared ends not being considered to be part of said elongated slot, said elongated slot is to receive said guide blade of a said vehicle moving on said track, said elongated slot having a first minimum width;

a centering rail section having a through centering slot located between second flared ends not considered to be part of said through centering slot, said centering rail section being located directly adjacent but spaced from said guide rail section with said through centering slot being in alignment with said elongated slot, said through centering slot having a second minimum width, said second minimum width being less than said first minimum width, said through centering slot also having a maximum width, said maximum width being approximately equal in width to said first minimum width; and a brake section having a through braking slot, said brake section being located directly adjacent but spaced from said centering rail section with said through braking slot being in alignment with said through centering slot, said through braking slot being adjustable in width between a wide value and a narrow value, said second minimum width being less than said wide value, whereby said guide blade is to pass through said elongated slot and into said through centering slot at said maximum width location and then exit said through centering slot at said second minimum width which will substantially center said guide blade within said through braking slot.

2. The track as defined in claim 1 wherein:

said through centering slot being tapered from said maximum width to said second minimum width.

3. In combination with a human amusement ride which has a vehicle to be operated on a track, said vehicle having a guide blade that protrudes outwardly, said track having a guide rail, said guide rail extending a substantial distance of the overall length of said track, said track terminating in a braking area, said braking area comprising a plurality of separate braking units, each said braking unit having a through braking slot, said guide blade to pass through each said braking slot, each said braking unit to apply a braking force to said guide blade to thereby slow and eventually stop said vehicle, the improvement comprising:

a centering rail section located directly adjacent each said braking unit with there being a separate said centering rail section for each said braking unit, each said centering rail section having a through centering slot through which said guide blade is to pass, said guide blade is to pass through a said through centering slot prior to entry into a said through braking slot, said through centering slot having a longitudinal center axis which aligns with the longitudinal center axis of said through braking slot, said through braking slot having a maximum width which is constant along the length of said braking slot except for flared ends, said through centering slot having a second width located nearest its respective said braking unit, said minimum width being less than said maximum width.

4. The combination as defined in claim 3 wherein:

said minimum width being slightly larger in size than the thickness of said guide blade.

5. The combination as defined in claim 3 wherein:

said through centering slot being tapered.

6. The combination as defined in claim 3 wherein:

said through centering slot having a greater width excepting the width of third flared ends of said centering rail section, said greater width being located furthest from its respective said braking unit, said greater width being approximately equal to said maximum width.

7. The combination as defined in claim 6 wherein:

said through centering slot being tapered.

8. The combination as defined in claim 7 wherein:

said minimum width being slightly larger in size than the thickness of said guide blade.

9. In combination with a vehicle in a human amusement ride where said vehicle is to operatively move on a track in a direction of travel, said track having engagement means, said vehicle having engaging means, said track having a braking area which includes a plurality of spaced apart braking units located in alignment along said direction of travel, the improvement comprising:

centering means mounted within said track, said centering means comprising a plurality of centering rail sections, there being a separate centering rail section for each said braking unit, said centering rail sections being in alignment along said direction of travel, there being a single said centering rail section located between each directly adjacent pair of said braking units, said centering means being of thinner width than said braking unit, for centrally positioning of said engaging means just prior to said engaging means connecting with each said brake unit, thereby substantially eliminating any small movements of said engaging means transverse to said direction of travel which produce an inferior braking operation.

10. The combination as defined in claim 9 wherein:

said engaging means comprises a guide blade that protrudes from said vehicle, each said braking unit having a through braking slot through which said guide blade is to pass, said guide blade to pass through a centering rail section prior to connection with a said braking unit, each said centering rail section having a through centering slot, said through centering slot being tapered.

* * * * *